US007513839B2

(12) United States Patent
Nardacci et al.

(10) Patent No.: US 7,513,839 B2
(45) Date of Patent: Apr. 7, 2009

(54) GOLF BALL WITH IMPROVED DIMPLE PATTERN

(75) Inventors: Nicholas M. Nardacci, Bristol, RI (US); Kevin M. Harris, New Bedford, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/923,742

(22) Filed: Oct. 25, 2007

(65) Prior Publication Data

US 2008/0043029 A1 Feb. 21, 2008

Related U.S. Application Data

(62) Division of application No. 11/049,609, filed on Feb. 3, 2005, now Pat. No. 7,303,491.

(51) Int. Cl.
*A63B 37/12* (2006.01)

(52) U.S. Cl. ..... 473/378

(58) Field of Classification Search ..... 473/378–385
See application file for complete search history.

(56) References Cited

U.S. PATENT DOCUMENTS 5,842,937 A 12/1998 Dalton et al.
6,338,684 B1 1/2002 Winfield et al.
6,699,143 B2 3/2004 Nardacci et al.
6,702,696 B1 3/2004 Nardacci
2003/0069089 A1 * 4/2003 Winfield et al. ..... 473/378

OTHER PUBLICATIONS

Mandelbrot, Benoit B. *The Fractal Geometry of Nature*, W.H. Freeman and Company, New York (1983).

Ochoa, Gabriela, "An Introduction to Lindenmayer Systems", http://www.biologie.uni-hamburg.de/b-online/e28-3/ISYS.html (last accessed on Jan. 14, 2005).

Weisstein, Eric W., "Sierpinski Arrowhead Curve", http://mathworld.wolfram.com/Sierpinski Arrowhead Curve.html (last accesed on Jan. 14, 2005).

Weisstein, Eric W., "Sierpinski Sieve", http://mathworld.wolfram.com/SierpinskiSieve.html (last accessed on Jan. 14, 2005).

* cited by examiner

*Primary Examiner*—Raeann Trimiew
(74) *Attorney, Agent, or Firm*—Mandi B. Milbank

(57) ABSTRACT

A golf ball comprising a substantially spherical outer surface and a plurality of dimples formed thereon is provided. To pack the dimples on the outer surface, the outer surface is first divided into Euclidean geometry based shapes. These Euclidean portions are then mapped with an L-system generated pattern. The dimples are then arranged within the Euclidean portions according to the L-system generated pattern.

12 Claims, 10 Drawing Sheets

GOLF BALL WITH IMPROVED DIMPLE PATTERN

RELATED APPLICATIONS

The present application is a divisional application of U.S. application Ser. No. 11/049,609, filed on Feb. 3, 2005, now U.S. Pat. No. 7,303,491,which is hereby incorporated by reference in its entirety.

FIELD OF THE INVENTION

The present invention relates to golf balls, and more particularly, to a golf ball having improved dimple patterns.

BACKGROUND OF THE INVENTION

Golf balls generally include a spherical outer surface with a plurality of dimples formed thereon. Historically dimple patterns have had an enormous variety of geometric shapes, textures and configurations. Primarily, pattern layouts provide a desired performance characteristic based on the particular ball construction, material attributes, and player characteristics influencing the ball's initial launch conditions. Therefore, pattern development is a secondary design step, which is used to fit a desired aerodynamic behavior to tailor ball flight characteristics and performance.

Aerodynamic forces generated by a ball in flight are a result of its translation velocity, spin, and the environmental conditions. The forces, which overcome the force of gravity, are lift and drag.

Lift force is perpendicular to the direction of flight and is a result of air velocity differences above and below the ball due to its rotation. This phenomenon is attributed to Magnus and described by Bernoulli's Equation, a simplification of the first law of thermodynamics. Bernoulli's equation relates pressure and velocity where pressure is inversely proportional to the square of velocity. The velocity differential—faster moving air on top and slower moving air on the bottom—results in lower air pressure above the ball and an upward directed force on the ball.

Drag is opposite in sense to the direction of flight and orthogonal to lift. The drag force on a ball is attributed to parasitic forces, which consist of form or pressure drag and viscous or skin friction drag. A sphere, being a bluff body, is inherently an inefficient aerodynamic shape. As a result, the accelerating flow field around the ball causes a large pressure differential with high-pressure in front and low-pressure behind the ball. The pressure differential causes the flow to separate resulting in the majority of drag force on the ball. In order to minimize pressure drag, dimples provide a means to energize the flow field triggering a transition from laminar to turbulent flow in the boundary layer near the surface of the ball. This transition reduces the low-pressure region behind the ball thus reducing pressure drag. The modest increase in skin friction, resulting from the dimples, is minimal thus maintaining a sufficiently thin boundary layer for viscous drag to occur.

By using dimples to decrease drag and increase lift, most manufactures have increased golf ball flight distances. In order to improve ball performance, it is thought that high dimple surface coverage with minimal land area and symmetric distribution is desirable. In practical terms, this usually translates into 300 to 500 circular dimples with a conventional sized dimple having a diameter that typically ranges from about 0.120 inches to about 0.180 inches.

Many patterns are known and used in the art for arranging dimples on the outer surface of a golf ball. For example, patterns based in general on three Platonic solids: icosahedron (20-sided polyhedron), dodecahedron (12-sided polyhedron), and octahedron (8-sided polyhedron) are commonly used. The surface is divided into these regions defined by the polyhedra, and then dimples are arranged within these regions.

Additionally, patterns based upon non-Euclidean geometrical patterns are also known. For example, in U.S. Pat. Nos. 6,338,684 and 6,699,143, the disclosures of which are incorporated herein by reference, disclose a method of packing dimples on a golf ball using the science of phyllotaxis. Furthermore, U.S. Pat. No. 5,842,937, the disclosure of which is incorporated herein by reference, discloses a golf ball with dimple packing patterns derived from fractal geometry. Fractals are discussed generally, providing specific examples, in Mandelbrot, Benoit B., *The Fractal Geometry of Nature,* W.H. Freeman and Company, New York (1983), the disclosure of which is hereby incorporated by reference.

However, the current techniques using fractal geometry to pack dimples does not provide a symmetric covering on the Euclidean spherical surface of a golf ball. Further, the existing methods does not allow for equatorial breaks and parting lines.

SUMMARY OF THE INVENTION

The present invention is directed to a golf ball having a substantially spherical outer surface. A plurality of surface textures is disposed on the outer spherical surface in a pattern. A texture is defined as a number of depressions or protrusions from the outer spherical surface forming a pattern covering said surface. The pattern comprises a Lindenmayer-system or L-system generated pattern on at least one portion of the outer spherical surface, wherein the portion of the outer spherical surface is defined by Euclidean geometry.

The present invention is further directed to a dimple pattern for a golf ball. The dimple pattern includes a plurality of Euclidean geometry-defined portions and at least a portion of an L-system generated pattern mapped onto at least one of the Euclidean geometry-defined portions.

The present invention is further directed to a method for placing a surface texture on an outer surface of a golf ball. The steps of the method include segmenting the outer surface into a plurality of Euclidean geometry-based shapes, mapping a first set of surface texture vertices within at least one of the Euclidean geometry-based shapes using at least a segment of an L-system generated pattern, and packing the surface texture on the outer surface according to the L-system generated pattern.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

L-systems, also known as Lindenmayer systems or string-rewrite systems, are mathematical constructs used to produce or describe iterative graphics. Developed in 1968 by a Swedish biologist named Aristid Lindenmayer, they were employed to describe the biological growth process. They are extensively used in computer graphics for visualization of plant morphology, computer graphics animation, and the generation of fractal curves. An L-system is generated by manipulating an axiom with one or more production rules. The axiom, or initial string, is the starting shape or graphic, such as a line segment, square or similar simple shape. The production rule, or string rewriting rule, is a statement or series of statements providing instruction on the steps to perform to manipulate the axiom. For example, the production rule for a line segment axiom may be "replace all line segments with a right turn, a line segment, a left turn, and a line segment." The system is then repeated a certain number of iterations. The resultant curve is typically a complex fractal curve.

L-system patterns are most easily visualized using "turtle graphics". Turtle graphics were originally developed to introduce children to basic computer programming logic. In turtle graphics, an analogy is made to a turtle walking in straight line segments and making turns at specified points. A state of a turtle is defined as a triplet (x, y, a), where the Cartesian coordinates (x, y) represent the turtle's position, and the angle a, called the heading, is interpreted as the direction in which the turtle is facing. Given a step size d and the angle increment b, the turtle may respond to the commands shown in Table 1.

TABLE 1

| Symbol | Command | New Turtle State |
|---|---|---|
| F | Move forward a step of length d and draw a line segment between initial turtle position and new turtle state. | (x', y', a), where x' = x + d cos(a) and y' = y + d sin(a). |
| f | Move forward a step of length d without drawing a line segment. | (x', y', a), where x' = x + d cos(a) and y' = y + d sin(a). |
| + | Turn left by angle b. | (x, y, a + b) |
| − | Turn left by angle b. | (x, y, a − b) |

Figure 1A:
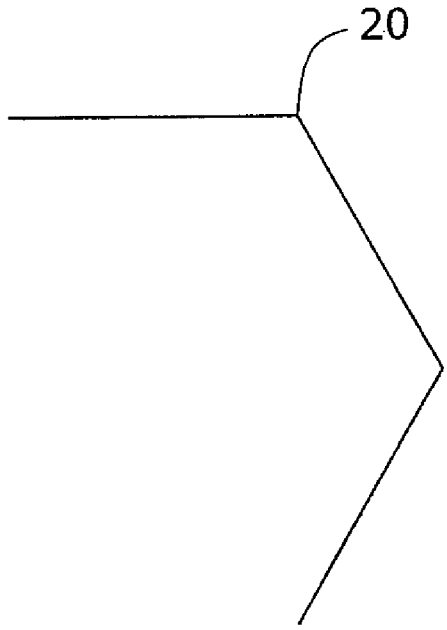
FIG. 1A is a schematic view of a parallel string-rewrite axiom.

This turtle analogy is useful in describing L-systems due to the recursive nature of the L-system pattern. Additional discussion of using turtle graphics to describe L-systems is found on Ochoa, Gabriela, "An Introduction to Lindenmayer Systems", http://www.biologie.uni-hamburg.de/b-online/e28_3/lsys.html (last accessed on Jan. 14, 2005). FIGS. 1A-1D show an example of generating a pattern, namely the Sierpinski Arrowhead Curve, using an L-system. Additional discussion of this curve may be found on Weisstein, Eric W., "Sierpinski Arrowhead Curve" http://mathworld.wolfram.com/SierpinskiArrowheadCurve.html (last accessed on Jan. 14, 2005). FIG. 1A shows an axiom 20 which may be represented by the following string:

"YF" Eq. 1

Figure 1B:
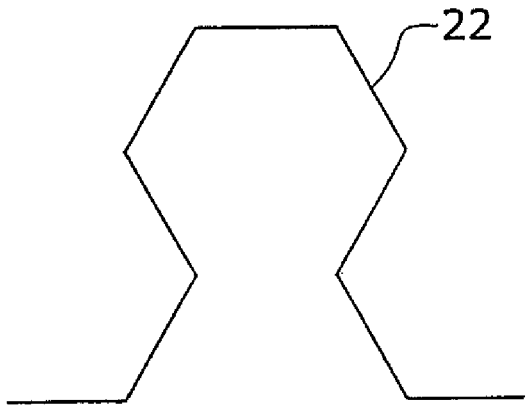
FIG. 1B is a schematic view of the axiom of FIG. 1A after a first iteration of a production rule.
Figure 1C:
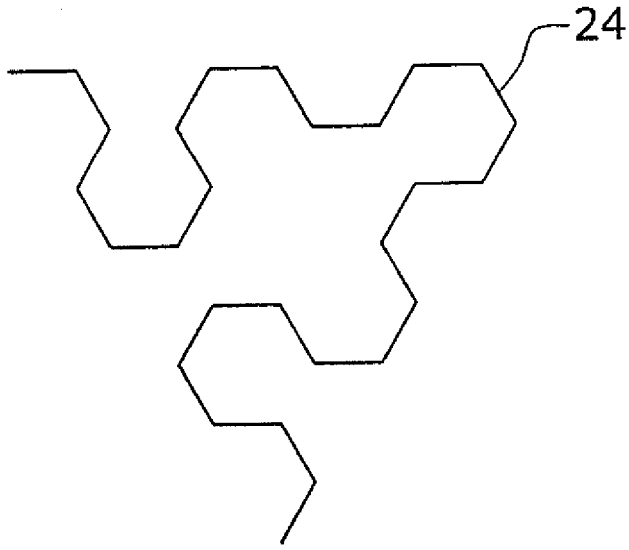
FIG. 1C is a schematic view of the axiom of FIG. 1A after a second iteration of the production rule.
Figure 1D:
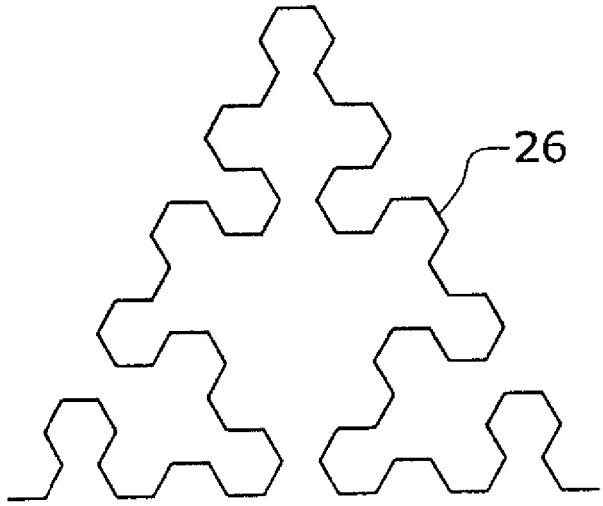
FIG. 1D is a schematic view of the axiom of FIG. 1A after a third iteration of the production rule.

The production rules are:

$$\text{“}X\text{”} \rightarrow \text{“}YF+XF+Y\text{”} \quad \text{Eq. 2}$$

$$\text{“}Y\text{”} \rightarrow \text{“}XF-YF-X\text{”} \quad \text{Eq. 3}$$

where b=60°. FIG. 1B shows a first pattern 22 generated after a first iteration of the production rules in axiom 20. FIG. 1C shows a second pattern 24 generated after a second application of the production rules on first pattern 22. FIG. 1D shows a final pattern 26 generated after a third application of the production rules on second pattern 24. As known in the art, three applications of the production rules is not the only stopping point for an L-system. Depending upon the desired gradation of the end result, the production rules may be applied 1, 2, 3 . . . n times.

Figure 2:
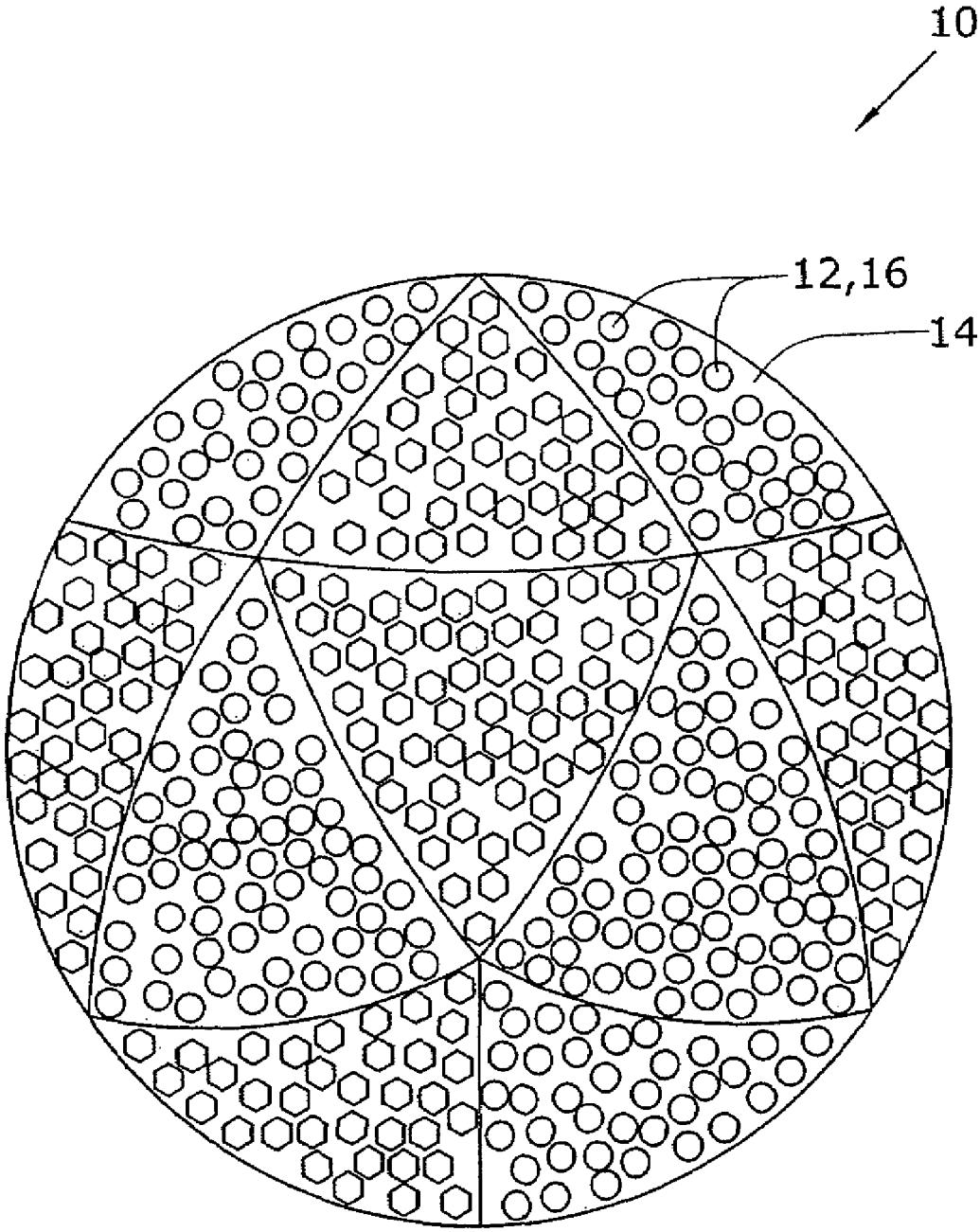
FIG. 2 is a front view of a golf ball having a dimple pattern plotted according to the present invention.

FIG. 2 shows a golf ball 10 having surface texture 12 disposed on a spherical outer surface 14 thereof. Surface texture 12 may be any appropriate surface texture known in the art, such as circular dimples, polygonal dimples, other non-circular dimples, catenary dimples, conical dimples, dimples of constant depth or protrusions. Preferably, surface texture 12 is a plurality of spherical dimples 16.

Figure 3:
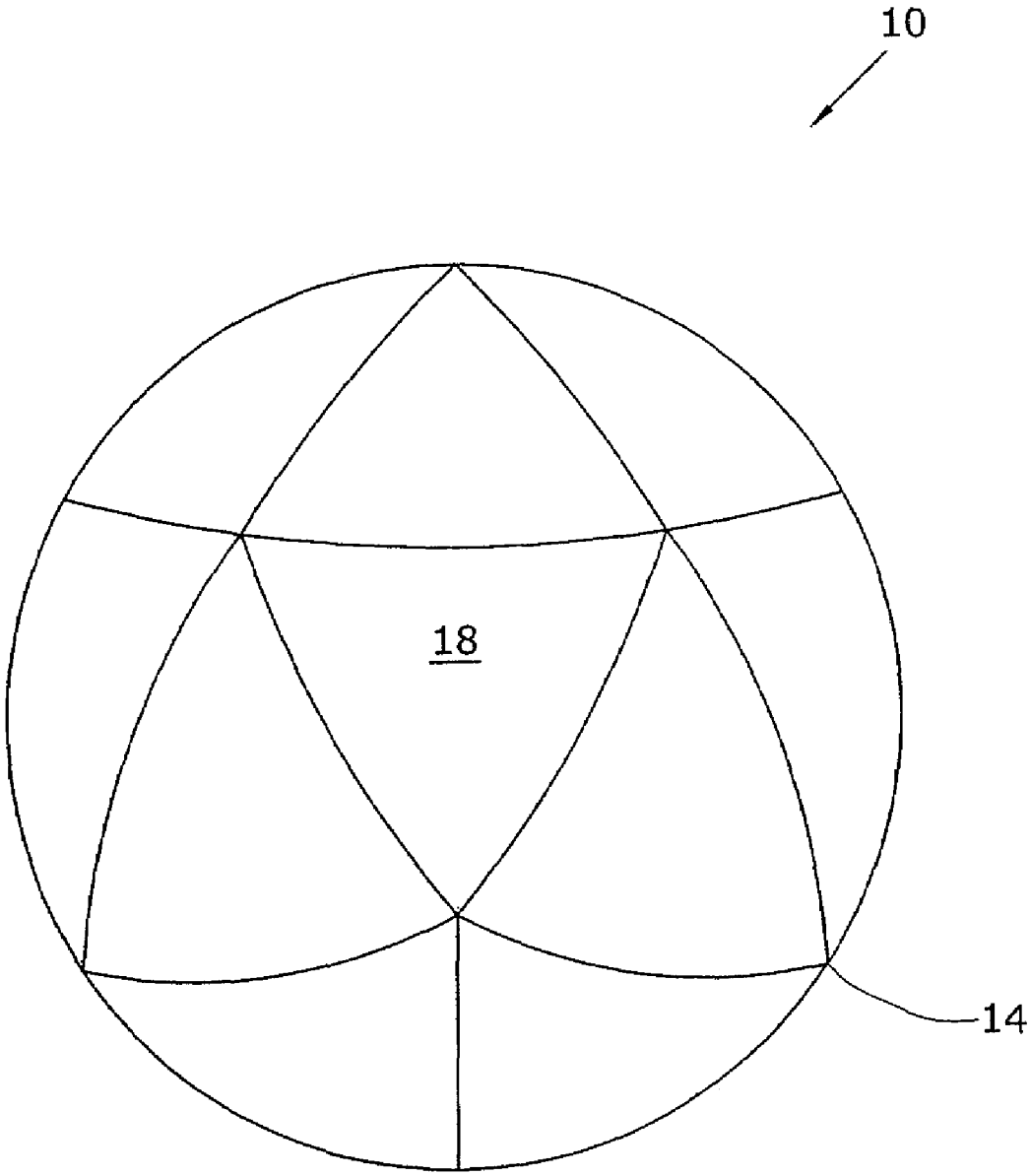
FIG. 3 is a front view of an outer surface of a golf ball segmented into portions.

Preferably dimples 16 are arranged on outer surface 14 in a pattern selected to maximize the coverage of outer surface 14 of golf ball 10. FIGS. 3 and 4 show the preferred mapping and dimple packing technique. First, as shown in FIG. 3, outer surface 14 is divided into portions 18. These portions may have any shape, such as square, triangular or any other shape taken from Euclidean geometry. Preferably, outer surface 14 is divided into portions that maximize coverage of the sphere, such as polyhedra. Even more preferably, outer surface 14 is divided into portions that form an icosahedron, octahedron, or dodecahedron pattern. FIG. 3 shows outer surface 14 divided into an icosahedron pattern.

Figure 4A:
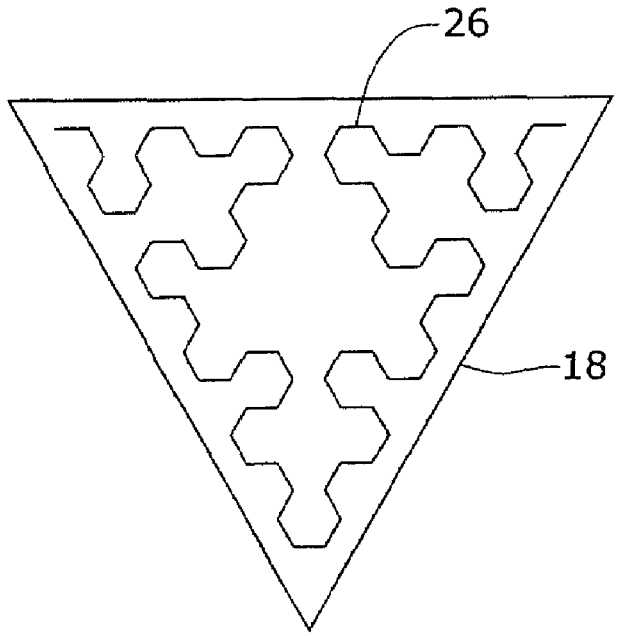
FIG. 4A is an enlarged view of a portion of the golf ball of FIG. 2 having the pattern of FIG. 1D mapped thereupon.

In accordance to the present invention, once outer surface 14 has been divided into Euclidean portions 18, an L-system is used to map a fractal pattern within a Euclidean portion 18. For example, in FIG. 3, the new pattern would be mapped to one of the faces of the icosahedron. FIG. 4A shows an enlarged view of a single portion 18 with final pattern 26 from FIG. 1D mapped thereupon. The mapping of the L-system onto portions 18 of spherical outer surface is preferably performed using computer programs, such as computer aided drafting, but may also be done manually.

Figure 4B:
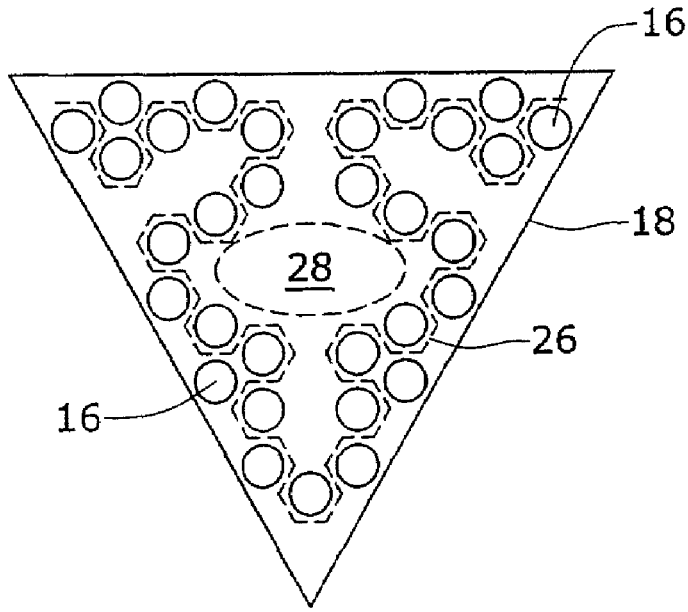
FIG. 4B is an enlarged view of the portion of FIG. 4A with dimples packed thereupon according to the pattern of FIG. 1D.

FIG. 4B shows single portion 18 with dimples 16 arranged thereupon following the mapping as shown in FIG. 4A. Dimples 16 are preferably packed manually, i.e., a designer chooses where to place dimples 16 along the general pattern created by the L-system. Alternatively, dimples 16 may be arranged using a computer program placing dimples 16 at pre-determined locations along final pattern 26. For example, dimples 16 may be placed at the juncture of two line segments; dimples 16 may be placed with the center point of a dimple 16 positioned at the center point of a line segment; a dimple 16 is positioned such that a line segment of pattern 26 is a tangent of dimple 16; dimples 16 placed such that at least two line segments of pattern 26 are tangent; dimples 16 placed such that 2 or more neighboring line segments of pattern 26 are tangent; dimple 16 vertex position is determined by at least 4 line segment vertices of pattern 26 which may or may not be neighboring line segments; dimples 16 must be positioned such that the center of any one dimple is at least one diameter from the center of a neighboring dimple (i.e., no dimples 16 may overlap). These positioning rules may be used exclusively or in combination.

Another method for efficient dimple packing is described in U.S. Pat. No. 6,702,696, the disclosure of which is hereby incorporated by reference. In the '696 patent, dimples 16 are randomly placed on outer surface 14 and assigned charge values, akin to electrical charges. The potential, gradient, minimum distance between any two points and average distance between all points are then calculated using a computer. Dimples 16 are then re-positioned according to a gradient based solution method. In applying the '696 method of charged values to the present invention, dimples 16 may be positioned randomly along pattern 26 and assigned charge values. The computer then processes the gradient based solution and rearranges dimples 16 accordingly.

Figure 4C:
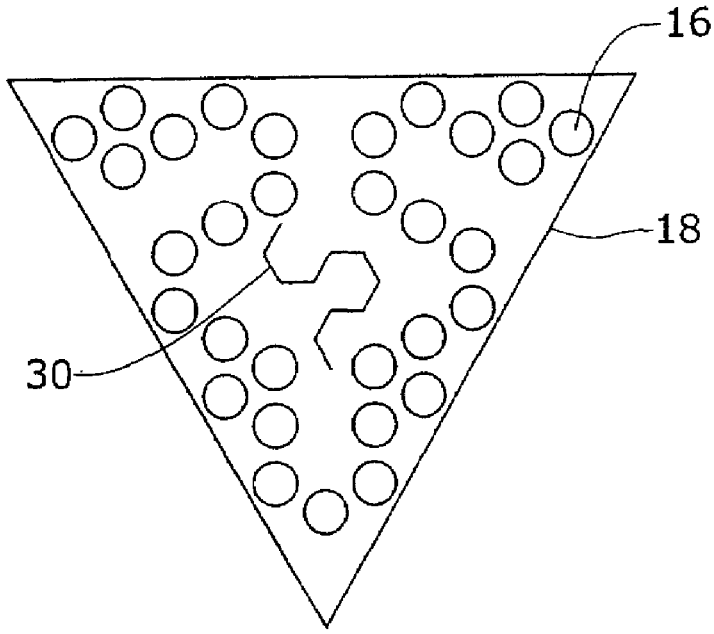
FIG. 4C is an enlarged view of the portion of FIG. 4A with a sub-pattern mapped thereupon.
Figure 4D:
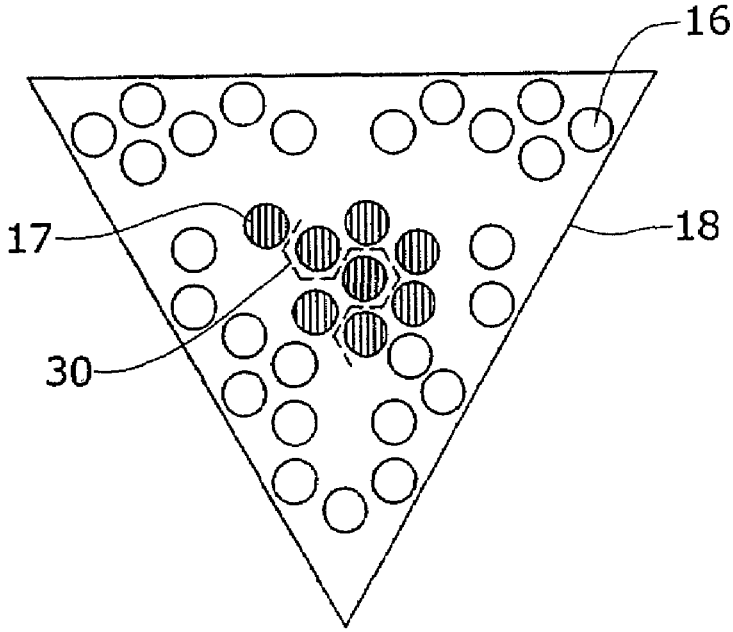
FIG. 4D is an enlarged view of the portion of FIG. 4A with dimples packed thereupon according to the sub-pattern of FIG. 4C.

As can be seen in FIG. 4B, dimples 16 as arranged according to the L-system pattern do not necessarily provide maximum coverage of portion 18. To fill an area of empty space such as area 28, a designer may simply fill in area 28 with dimples 16 in a best-fit manner. Preferably, however, a sub-pattern 30 of an L-system can be used to provide greater coverage. Sub-pattern 30 may be a part of the L-system chosen for the larger pattern 26 or an entirely different L-system pattern may be used. As shown in FIG. 4C, sub-pattern 30, one branch of pattern 26, has been mapped onto area 28. FIG. 4D shows how filler dimples 17 have been placed along sub-pattern 30 following the same or similar rules for the placement of dimples 16 onto pattern 26. This process may be repeated as often as necessary to fill portion 18. Typically, maximized coverage results in the placement of 300-500 dimples on outer surface 14.

Figure 5:
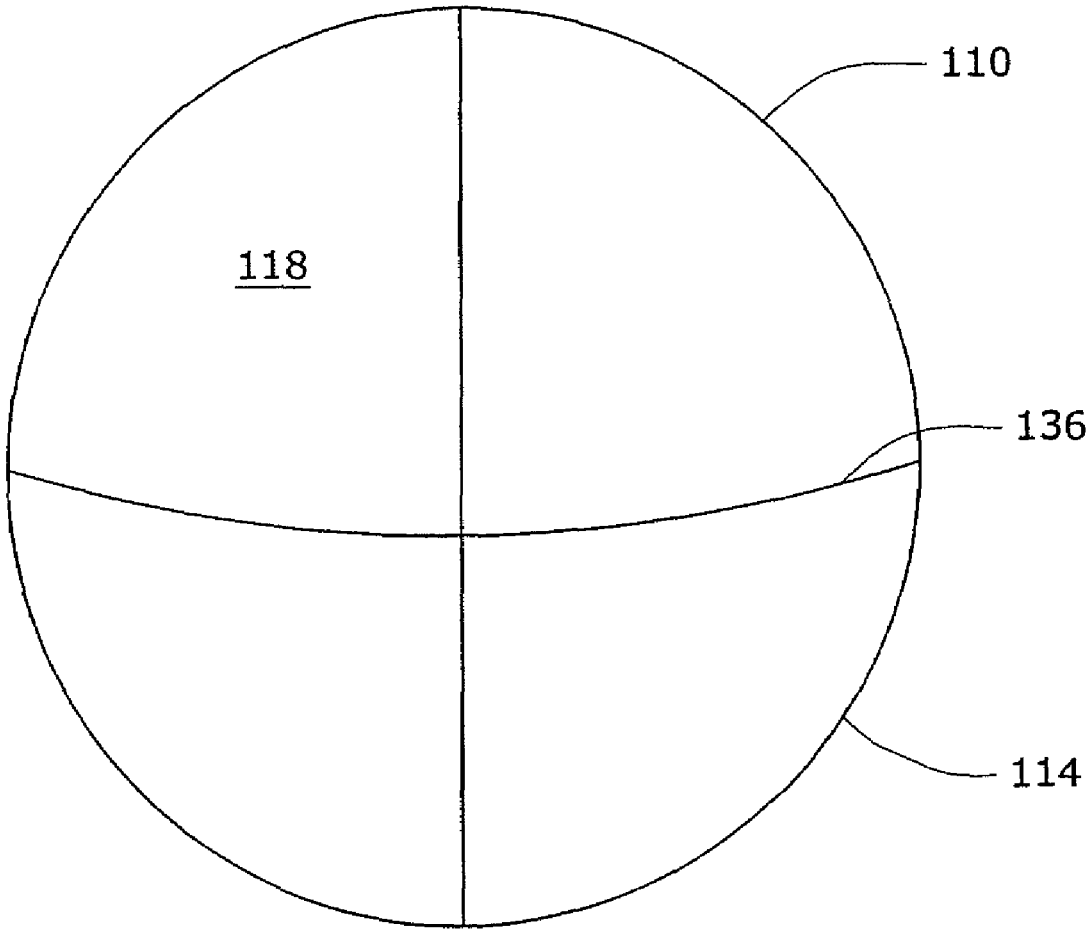
FIG. 5 is a front view of an alternate embodiment of an outer surface of a golf ball segmented into portions.

This method of dimple packing is particularly suited to efficient dimple placements that account for parting lines on the spherical outer surface of the ball. An alternate embodiment reflecting this aspect of the invention is shown in FIG. 5. A golf ball 110 having a spherical outer surface 114 has been divided into Euclidean portions 118 that do not cross an equatorial parting line 136. As shown in FIG. 5, outer surface 114 has been divided into an octahedral configuration. Many other Euclidean shape-based divisions may be used to divide outer surface 114 into portions 118 without crossing parting lines, such as icosahedral, dodecahedral, etc.

Figure 6:
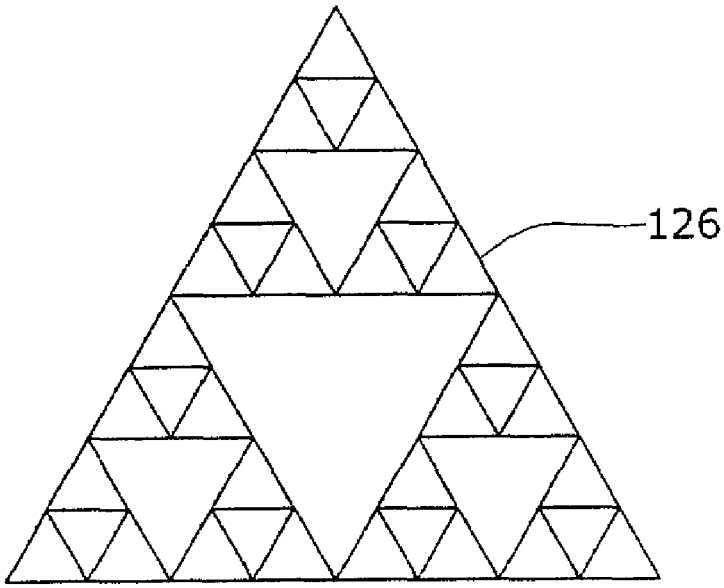
FIG. 6 is a schematic view of a fractal pattern.

FIG. 6 shows another L-system pattern appropriate for use with the present invention. Pattern 126 is a fractal known as the Sierpinski Sieve, the Sierpinski Triangle or the Sierpinski Gasket. Additional discussion of this curve can be found on Weisstein, Eric W., "Sierpinski Sieve" http://mathworld.wolfram.com/SierpinskiSieve.html (last accessed on Jan. 14, 2005). This pattern may be formed using the axiom:

$$\text{"F+F+F"} \qquad \text{Eq. 4}$$

and the production rule:

$$\text{"}F \rightarrow F+F-F-F+F\text{"} \qquad \text{Eq. 5}$$

where b=120° and n=3, where n is the number of iterations.

Figure 7A:
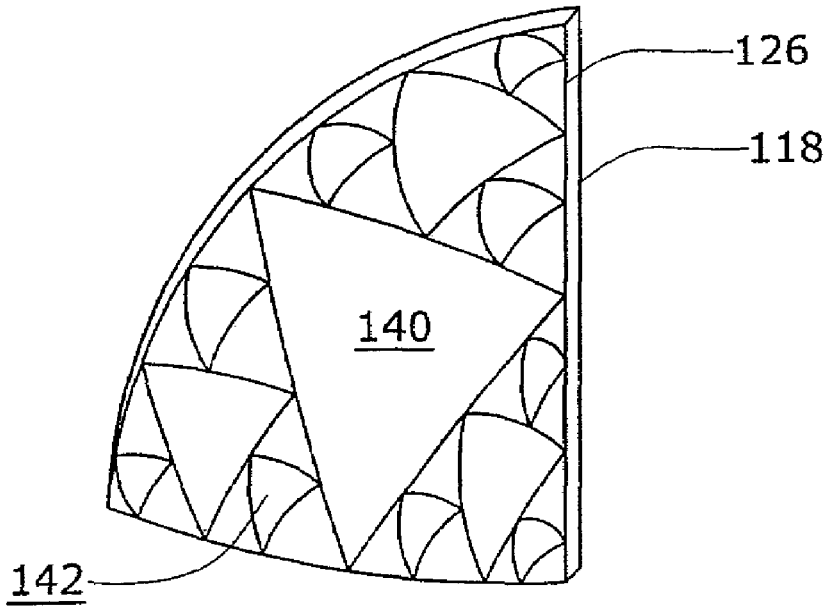
FIG. 7A is an enlarged view of a portion of the golf ball of FIG. 5 having the pattern of FIG. 6 mapped thereupon.
Figure 7B:
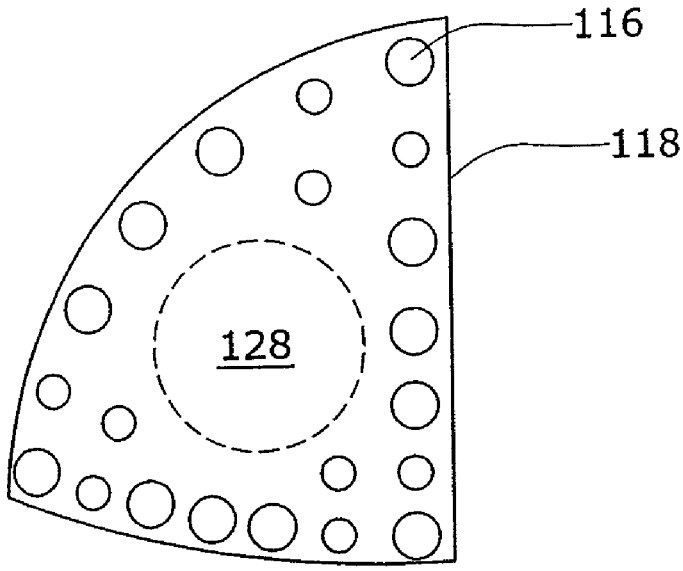
FIG. 7B is an enlarged view of the portion of FIG. 7A with dimples packed thereupon according to the pattern of FIG. 6.

FIG. 7A shows pattern 126 mapped onto portion 118, in this embodiment, one of the faces of the octahedron. Pattern 126 includes triangles of varying sizes, such as larger triangles 140 and smaller triangles 142. FIG. 7B shows how dimples 116 may be packed onto portion 118 following mapped patter 126. The dimple packing is performed in a similar fashion to the dimple packing as described with respect to the embodiment shown in FIGS. 2-4D. In other words, the designer or computer program follows a set of rules regarding the placement of dimples 116. In FIG. 7B, dimples 116 have been placed at the vertices of the larger triangles 140 and are centered within smaller triangles 142. Alternatively, dimples 116 may be triangular dimples of varying size that simply replace triangles 140, 142 of pattern 126. In other words, pattern 126 is a precise template for dimples 116.

Figure 7C:
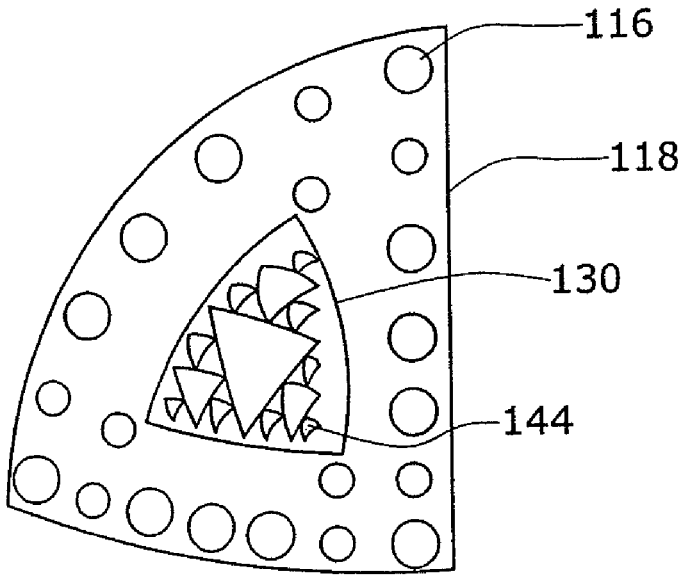
FIG. 7C is an enlarged view of the portion of FIG. 7A with a sub-pattern mapped thereupon.
Figure 7D:
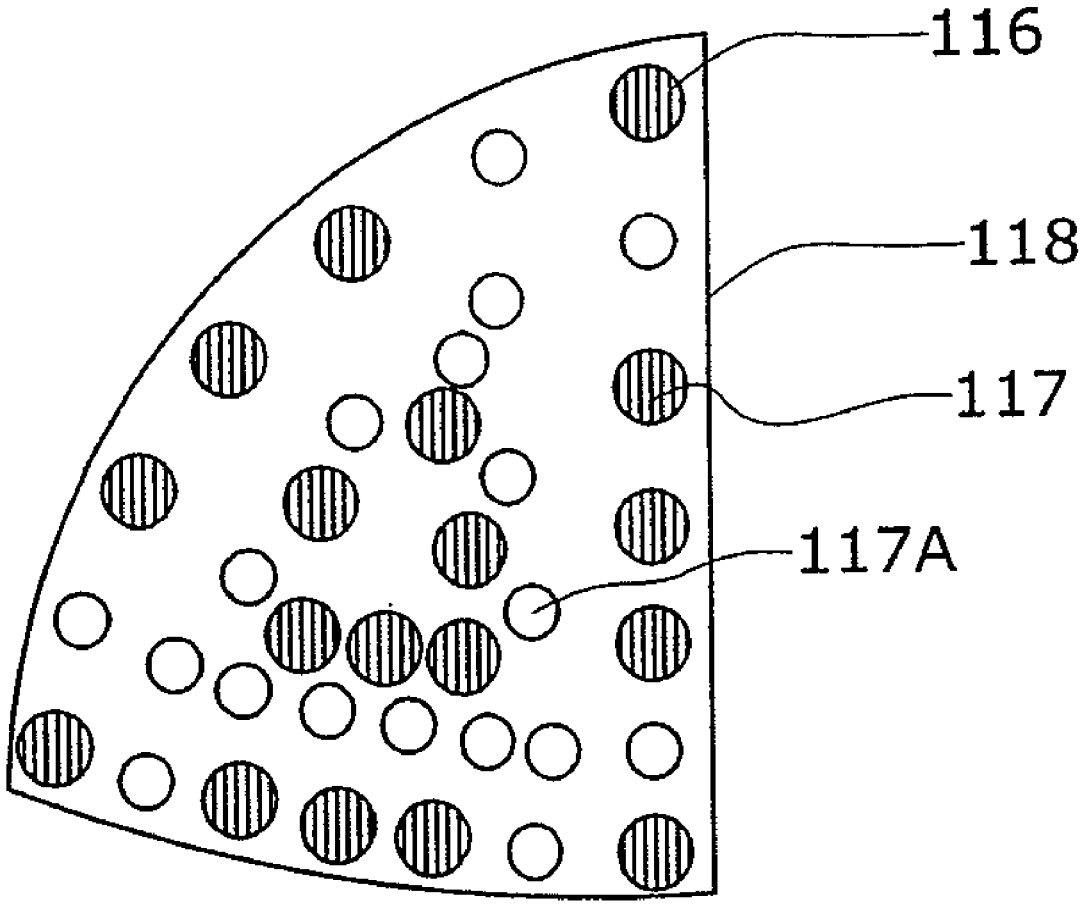
FIG. 7D is an enlarged view of the portion of FIG. 7A with dimples packed thereupon according to the sub-pattern of FIG. 7C.

As can be seen in FIG. 7B, an area 128 of empty space has been left in the center of portion 118 due to the large triangle 140 in the center of pattern 126. As shown in FIG. 7C and as described above with respect to FIGS. 4C and 4D, area 128 may be filled by mapping a sub-pattern 130 onto area 128 and then repeating the dimple packing process with filler dimples 117. In this embodiment, sub-pattern 130 is also a Sierpinski Sieve, although for sub-pattern 130 n=4. This additional iteration of the L-system pattern allows for very small triangles 144, which may then be replaced with small filler dimples 117A, thereby maximizing the dimple coverage. Small filler dimples 117A may be any size, for example, having the same diameter as the smallest of original dimples 116 or having a diameter that is greater or smaller than any of the original dimples 116. Preferably, small filler dimples 117A are equal to or smaller than the smallest of original dimples 116. Typically, maximized coverage results in the placement of 300-500 dimples on outer surface 114. This process may be repeated as often as necessary to fill portion 118.

The L-system patterns appropriate for use with the present invention are not limited to those discussed above. Any L-system pattern that may be mapped in two-dimensional space or to a curvilinear surface may be used, for example, various fractal patterns including but not limited to the box fractal, the Cantor Dust fractal, the Cantor Square fractal, the Sierpinski carpet and the Sierpinski curve.

While various descriptions of the present invention are described above, it is understood that the various features of the embodiments of the present invention shown herein can be used singly or in combination thereof. For example, the dimple depth may be the same for all the dimples. Alternatively, the dimple depth may vary throughout the golf ball. The dimple depth may also be shallow to raise the trajectory of the ball's flight, or deep to lower the ball's trajectory. Also, the L-system or fractal pattern used may be any such pattern known in the art. This invention is also not to be limited to the specifically preferred embodiments depicted therein.

What is claimed is:

1. A method for placing a surface texture on an outer surface of a golf ball comprising:

segmenting the outer surface into a plurality of Euclidean geometry-based shapes;

mapping a first set of surface texture placement locations within at least one of the Euclidean geometry-based shapes using at least a segment of an L-system generated pattern;

packing the surfacetexture on the outer surface according to the L-system generated pattern; and filling in an area lacking sufficient surface texture coverage by mapping a second set of surface texture placement locations in the area using at least a segment of a second L-system generated pattern, wherein the second L-system generated pattern may be the same as or different from the L-system generated pattern.

2. The method of claim 1, wherein the surface texture is packed manually.

3. The method of claim 1, wherein the surface texture is packed using a computer program.

4. The method of claim 1, wherein the L-system generated pattern is a template for the surface texture.

5. A method for placing a surface texture on an outer surface of a golf ball comprising:

segmenting the outer surface into a plurality of Euclidean geometry-based shapes;

mapping a first set of surface texture placement locations within at least one of the Euclidean geometry-based shapes using at least a segment of an L-system generated pattern;

packing the surface texture on the outer surface according to the L-system generated pattern; and placing the surface textures at random intervals along the L-system generated pattern;

assigning the surface textures a charge value;

determining a gradient based solution; and rearranging the surface textures according to the gradient based solution.

6. The method of claim 5, wherein the surface texture is packed manually.

7. The method of claim 5, wherein the surface texture is packed using a computer program.

8. The method of claim 5, wherein the L-system generated pattern is a template for the surface texture.

9. A method for placing a surface texture on an outer surface of a golf ball comprising:

segmenting the outer surface into a plurality of Euclidean geometry-based shapes;

mapping a first set of surface texture placement locations within at least one of the Euclidean geometry-based shapes using at least a segment of an L-system generated pattern;

packing the surface texture on the outer surface according to the L-system generated pattern; and placing the surface textures at random locations defined by the L-system generated pattern;

assigning the surface textures a charge value;

computing a minimum potential energy state for the textures; and rearranging the surface textures according to the minimum potential energy state.

10. The method of claim 9, wherein the surface texture is packed manually.

11. The method of claim 6,wherein the surface texture is packed using a computer program.

12. The method of claim 9, wherein the L-system generated pattern is a template for the surface texture.

* * * * *